US010626858B2

(12) United States Patent
Du et al.

(10) Patent No.: US 10,626,858 B2
(45) Date of Patent: Apr. 21, 2020

(54) FLUID MACHINERY, HEAT EXCHANGE EQUIPMENT, AND OPERATING METHOD FOR FLUID MACHINERY

(71) Applicant: GREE GREEN REFRIGERATION TECHNOLOGY CENTER CO., LTD. OF ZHUHAI, Zhuhai, Guangdong (CN)

(72) Inventors: Zhongcheng Du, Guangdong (CN); Jia Xu, Guangdong (CN); Liping Ren, Guangdong (CN); Lingchao Kong, Guangdong (CN); Sen Yang, Guangdong (CN); Rongting Zhang, Guangdong (CN); Shebing Liang, Guangdong (CN); Liying Deng, Guangdong (CN); Jiakui Xu, Guangdong (CN); Jinquan Zhang, Guangdong (CN); Zhengliang Shi, Guangdong (CN)

(73) Assignee: GREE GREEN REFRIDGERATION TECHNOLOGY CENTER CO., LTD. OF ZUHAI, Zhuhai, Guangdong (CN)

( * ) Notice: Subject to any disclaimer, the term of this patent is extended or adjusted under 35 U.S.C. 154(b) by 194 days.

(21) Appl. No.: 15/750,962

(22) PCT Filed: Jun. 1, 2016

(86) PCT No.: PCT/CN2016/084320
§ 371 (c)(1),
(2) Date: Feb. 7, 2018

(87) PCT Pub. No.: WO2017/024863
PCT Pub. Date: Feb. 16, 2017

(65) Prior Publication Data

US 2018/0230981 A1 Aug. 16, 2018

(30) Foreign Application Priority Data

Aug. 7, 2015 (CN) ..... 2015 1 0483212

(51) Int. Cl.
*F04B 37/00* (2006.01)
*F04C 18/34* (2006.01)
(Continued)

(52) U.S. Cl.
CPC ..... *F04B 29/00* (2013.01); *F01C 21/08* (2013.01); *F01C 21/108* (2013.01);
(Continued)

(58) Field of Classification Search
CPC .. F04B 29/00; F04B 29/0071; F04B 27/0663; F04B 19/025; F04B 39/12;
(Continued)

(56) References Cited

U.S. PATENT DOCUMENTS 2,117,448 A * 5/1938 Pontis ..... F04B 27/0663 417/286
2,411,929 A * 12/1946 Malke ..... F04B 27/0465 417/462
(Continued)

FOREIGN PATENT DOCUMENTS

CN 1525071 A 9/2004
CN 264623 Y 10/2004
(Continued)

OTHER PUBLICATIONS

WIPO, International Search Report dated Sep. 7, 2016.
(Continued)

*Primary Examiner* — Charles G Freay
(74) *Attorney, Agent, or Firm* — Li & Cai Intellectual Property (USA) Office

(57) ABSTRACT

A fluid machinery, a heat exchange equipment, and an operating method for the fluid machinery. The fluid machin-
(Continued)

ery includes: an upper flange (50); a lower flange (60); a cylinder (20); a rotating shaft (10), the axis of the rotating shaft (10) being eccentric to the axis of the cylinder (20) and at a fixed eccentric distance; and a piston component (30), the piston component (30) being provided with a variable volume cavity (31). Because the eccentric distance between the rotating shaft (10) and the cylinder (20) is fixed, the rotating shaft (10) and the cylinder (20) rotate around the respective axes thereof during motion, and the position of the center of mass remains unchanged, so that the piston component is allowed to rotate stably and continuously when moving within the cylinder (20); and vibration of the fluid machinery is effectively mitigated.

28 Claims, 14 Drawing Sheets

(51) Int. Cl.

| | |
|---|---|
| ***F04B 19/02*** | (2006.01) |
| ***F04C 29/00*** | (2006.01) |
| ***F01C 21/10*** | (2006.01) |
| ***F01C 21/08*** | (2006.01) |
| ***F04B 39/00*** | (2006.01) |
| ***F04B 39/12*** | (2006.01) |

(52) U.S. Cl.
CPC ..... *F04B 19/025* (2013.01); *F04B 39/0005* (2013.01); *F04B 39/12* (2013.01); *F04C 18/34* (2013.01); *F04C 29/0071* (2013.01); *F04C 2240/20* (2013.01)

(58) Field of Classification Search
CPC .. F04B 39/0005; F04C 18/34; F04C 29/0071; F04C 2240/20; F04C 29/128; F04C 29/028; F04C 29/22; F01C 21/108; F01C 21/08
See application file for complete search history.

(56) References Cited

U.S. PATENT DOCUMENTS 3,279,445 A 10/1966 Karol
4,137,019 A * 1/1979 Hofmann ..... F01C 1/103 417/462

FOREIGN PATENT DOCUMENTS

| | | | | |
|---|---|---|---|---|
| CN | 2646423 | Y | | 10/2004 |
| CN | 2692379 | Y | | 4/2005 |
| CN | 2826012 | Y | | 10/2006 |
| CN | 102149922 | A | | 8/2011 |
| CN | 104454021 | A | | 3/2015 |
| CN | 204511881 | U | | 7/2015 |
| CN | 204877938 | U | | 12/2015 |
| CN | 204877939 | U | | 12/2015 |
| CN | 204877940 | U | | 12/2015 |
| CN | 204877941 | U | | 12/2015 |
| CN | 105604937 | A | | 5/2016 |
| CN | 205401107 | U | | 7/2016 |
| JP | 58-220977 | | * | 12/1983 |
| JP | H06272671 | A | | 9/1994 |
| JP | 2004011421 | A | | 1/2004 |
| JP | 2011085128 | A | | 4/2011 |
| WO | WO 02/12723 | A1 | | 2/2002 |
| WO | WO 2013/077388 | A1 | | 5/2013 |

OTHER PUBLICATIONS

European Patent Office, Search report dated Mar. 4, 2019.
Korean Patent Office, First examination report.
Japan Patent Office, First examination report.
China Patent Office, Search Report.

* cited by examiner

FLUID MACHINERY, HEAT EXCHANGE EQUIPMENT, AND OPERATING METHOD FOR FLUID MACHINERY

TECHNICAL FIELD

The present disclosure relates to the technical field of heat exchange systems, and more particularly to fluid machinery, heat exchange equipment, and an operating method for fluid machinery.

BACKGROUND

Fluid machinery in the related art includes a compressor, an expander and the like. The compressor is taken for example.

During motion, the positions of the center of mass of a rotating shaft and cylinder of a piston-type compressor in the related art are changed. A crankshaft is driven by a motor to output power, and the crankshaft drives a piston to make a reciprocating motion in the cylinder to compress gas or liquid to apply work, so as to achieve the aim of compressing gas or liquid.

A traditional piston-type compressor has several defects as follows. In the presence of a suction valve and an exhaust valve, the suction resistance and the exhaust resistance are increased, and the suction and exhaust noises are increased. A large lateral force is exerted on a cylinder of the compressor, and the lateral force applies an idle work, thereby reducing the efficiency of the compressor. A crankshaft drives a piston to make a reciprocating motion, and the eccentric mass is large, thereby causing large vibration of the compressor. The compressor drives one or more pistons to work via a crank-connecting rod mechanism, thereby being complex in structure. The lateral force exerted on the crankshaft and the piston is large, and the piston is easy to abrade, thereby reducing the sealing property of the piston. Moreover, the volume efficiency of the conventional compressor is low due to the reasons such as clearance volume and large leakage, and is difficult to increase.

In addition, the center of mass of an eccentric portion in a piston-type compressor makes a circular motion to generate a size-invariable and direction-variable centrifugal force, this centrifugal force increasing vibration of the compressor.

SUMMARY

The present disclosure is mainly directed to fluid machinery, heat exchange equipment, and an operating method for fluid machinery, intended to solve the problem in the related art in which fluid machinery is unstable in motion and large in vibration and has clearance volume.

To this end, according to an aspect of the present disclosure, fluid machinery is provided. The fluid machinery includes: an upper flange; a lower flange; a cylinder, the cylinder being sandwiched between the upper flange and the lower flange; a rotating shaft, the axis of the rotating shaft being eccentric to the axis of the cylinder and at a fixed eccentric distance, and the rotating shaft sequentially penetrating through the upper flange, the cylinder and the lower flange; and a piston component, the piston component being provided with a variable volume cavity, the piston component being pivotally provided in the cylinder, and the rotating shaft being drivingly connected with the piston component to change the volume of the variable volume cavity.

Further, the piston component includes: a piston sleeve, the piston sleeve being pivotally provided in the cylinder; and a piston, the piston being slidably provided in the piston sleeve to form the variable volume cavity, and the variable volume cavity being located in a sliding direction of the piston.

Further, the piston is provided with a sliding hole running through an axial direction of the rotating shaft, the rotating shaft penetrates through the sliding hole, and the piston rotates along with the rotating shaft under the driving of the rotating shaft and slides in the piston sleeve along a direction vertical to the axial direction of the rotating shaft in a reciprocating manner.

Further, the sliding hole is an slotted hole or a waist-shaped hole.

Further, the piston is provided with a pair of arc-shaped surfaces arranged symmetrically about a middle vertical plane of the piston, the arc-shaped surfaces adaptively match an inner surface of the cylinder, and the double arc curvature radius of the arc-shaped surfaces is equal to the inner diameter of the cylinder.

Further, the piston is columnar.

Further, a guide hole running through a radial direction of the piston sleeve is provided in the piston sleeve, and the piston is slidably provided in the guide hole to make a straight reciprocating motion.

Further, an orthographic projection of the guide hole at the lower flange is provided with a pair of parallel straight line segments, the pair of parallel straight line segments is formed by projecting a pair of parallel inner wall surfaces of the piston sleeve, and the piston is provided with outer profiles which are in shape adaptation to and in sliding fit with a pair of parallel inner wall surfaces of the guide hole.

Further, a first thrust surface of a side, facing the lower flange, of the piston sleeve is in contact with the surface of the lower flange.

Further, the rotating shaft is provided with a sliding segment in sliding fit with the piston component, the sliding segment is located between two ends of the rotating shaft, and the sliding segment is provided with sliding fit surfaces.

Further, the sliding fit surfaces are symmetrically provided on two sides of the sliding segment.

Further, the sliding fit surfaces are parallel with an axial plane of the rotating shaft, and the sliding fit surfaces are in sliding fit with an inner wall surface of the sliding hole of the piston in a direction vertical to the axial direction of the rotating shaft.

Further, the rotating shaft is provided with a oil passage, the oil passage including an internal oil channel provided inside the rotating shaft, an external oil channel arranged outside the rotating shaft and an oil communication hole communicating the internal oil channel and the external oil channel.

Further, the external oil channel extending along the axial direction of the rotating shaft is provided at the sliding fit surfaces.

Further, the upper flange and the lower flange are coaxial with the rotating shaft, and the axis of the upper flange and the axis of the lower flange being eccentric to the axis of the cylinder.

Further, the fluid machinery further includes a supporting plate, the supporting plate is provided on an end face, away from one side of the cylinder, of the lower flange, the supporting plate is coaxial with the lower flange, the rotating shaft penetrates through a through hole in the lower flange and is supported on the supporting plate, and the supporting plate is provided with a second thrust surface for supporting the rotating shaft.

Further, the fluid machinery further includes a limiting plate, the limiting plate being provided with an avoidance hole for avoiding the rotating shaft, and the limiting plate being sandwiched between the lower flange and the piston sleeve and coaxial with the piston sleeve.

Further, the piston sleeve is provided with a connecting convex ring protruding towards one side of the lower flange, the connecting convex ring being embedded into the avoidance hole.

Further, a cylinder wall of the cylinder is provided with a compression intake port and a first compression exhaust port, when the piston component is located at an intake position, the compression intake port is communicated with the variable volume cavity, and when the piston component is at an exhaust position, the variable volume cavity is communicated with the first compression exhaust port.

Further, an inner wall surface of the cylinder wall is provided with a compression intake buffer tank, the compression intake buffer tank is communicated with the compression intake port.

Further, the compression intake buffer tank is provided with an arc-shaped segment in a radial plane of the cylinder, and the compression intake buffer tank extends from the compression intake port to one side where the first compression exhaust port is located.

Further, the cylinder wall of the cylinder is provided with a second compression exhaust port, the second compression exhaust port is located between the compression intake port and the first compression exhaust port, and during rotation of the piston component, a part of gas in the piston component is depressurized by the second compression exhaust port and then completely exhausted from the first compression exhaust port.

Further, the fluid machinery further includes an exhaust valve component, the exhaust valve component being arranged at the second compression exhaust port.

Further, a receiving groove is provided on an outer wall of the cylinder wall, the second compression exhaust port runs through the groove bottom of the receiving groove, and the exhaust valve component is provided in the receiving groove.

Further, the exhaust valve component includes: an exhaust valve, the exhaust valve being provided in the receiving groove and shielding the second compression exhaust port; and a valve baffle, the valve baffle being overlaid on the exhaust valve.

Further, the fluid machinery is a compressor.

Further, the cylinder wall of the cylinder is provided with an expansion exhaust port and a first expansion intake port, when the piston component is located at an intake position, the expansion exhaust port is communicated with the variable volume cavity, and when the piston component is at an exhaust position, the variable volume cavity is communicated with the first expansion intake port.

Further, the inner wall surface of the cylinder wall is provided with an expansion exhaust buffer tank, the expansion exhaust buffer tank is communicated with the expansion exhaust port.

Further, the expansion exhaust buffer tank is provided with an arc-shaped segment in a radial plane of the cylinder, and the expansion exhaust buffer tank extends from the expansion exhaust port to one side where the first expansion intake port is located.

Further, the fluid machinery is a compressor.

Further, there are at least two guide holes spaced in the axial direction of the rotating shaft, there are at least two pistons, and each guide hole is provided with the corresponding piston.

According to another aspect of the present disclosure, heat exchange equipment is provided. The heat exchange equipment includes fluid machinery, the fluid machinery being the above fluid machinery.

According to another aspect of the present disclosure, an operating method for fluid machinery is provided. The operating method for fluid machinery includes: a rotating shaft rotates around the axis $O_1$ of the rotating shaft; a cylinder rotates around the axis $O_2$ of the cylinder, wherein the axis of the rotating shaft is eccentric to the axis of the cylinder and at a fixed eccentric distance; and a piston in a piston component rotates along with the rotating shaft under the driving of the rotating shaft and slides in a piston sleeve of the piston component along a direction vertical to an axial direction of the rotating shaft in a reciprocating manner.

Further, the operating method adopts a principle of cross slider mechanism, wherein the piston serves as a slider, a sliding fit surface of the rotating shaft serves as a first connecting rod $I_1$, and a guide hole of the piston sleeve serves as a second connecting rod $I_2$.

By means of the technical solutions of the present disclosure, a cylinder is sandwiched between an upper flange and a lower flange; the axis of a rotating shaft is eccentric to the axis of the cylinder and at a fixed eccentric distance, and the rotating shaft sequentially penetrates through the upper flange and the cylinder; and a piston component is provided with a variable volume cavity, the piston component being pivotally provided in the cylinder, and the rotating shaft being drivingly connected with the piston component to change the volume of the variable volume cavity. Because the eccentric distance between the rotating shaft and the cylinder is fixed, the rotating shaft and the cylinder rotate around the respective axes thereof during motion, and the position of the center of mass remains unchanged, so that the piston component is allowed to rotate stably and continuously when moving in the cylinder; and vibration of the fluid machinery is effectively mitigated, a regular pattern for changes in the volume of the variable volume cavity is ensured, and clearance volume is reduced, thereby increasing the operational stability of the fluid machinery, and increasing the working reliability of heat exchange equipment.

BRIEF DESCRIPTION OF THE DRAWINGS

The drawings of the description, forming a part of the present application, are used to provide a further understanding for the present disclosure. The schematic embodiments and descriptions of the present disclosure are used to explain the present disclosure, and do not form improper limits to the present disclosure. In the drawings.

Figure 1:
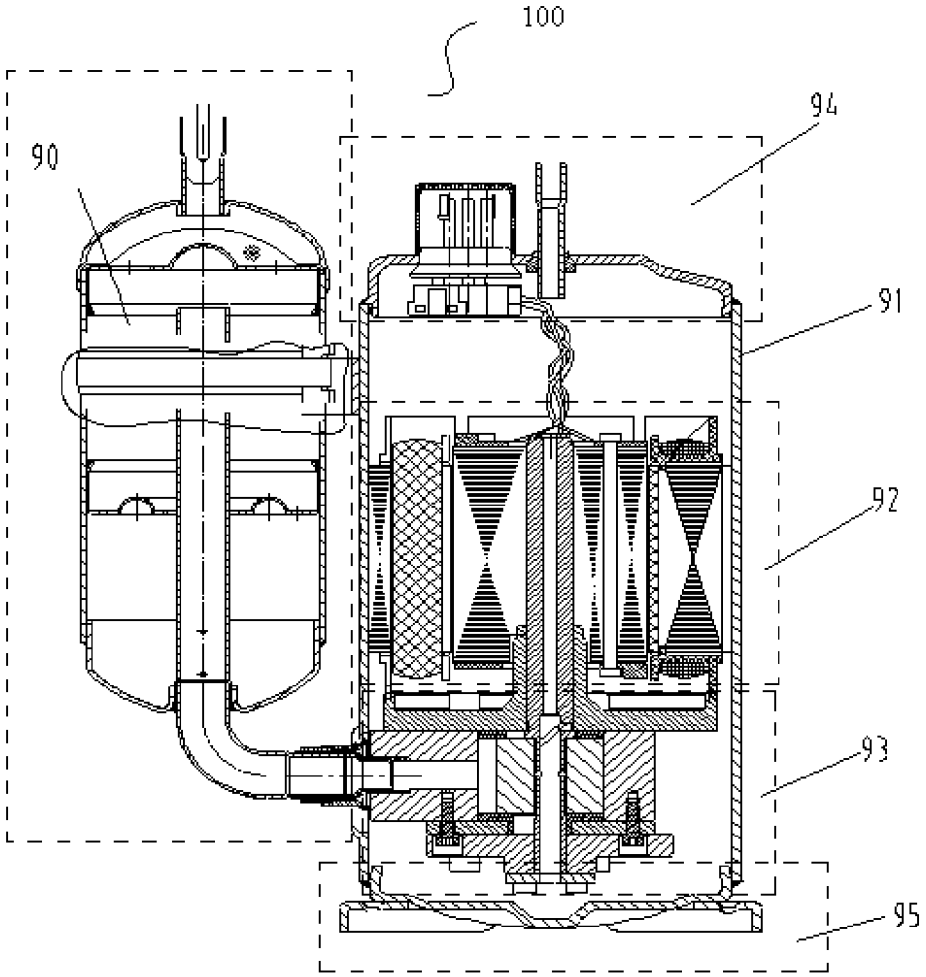
FIG. 1 shows a structure diagram of a compressor in the present disclosure.

Herein, the drawings include the following drawing marks:

1, rotating shaft; 11, sliding segment; 111, sliding fit surface; 13, oil passage; 14, oil communication hole; 15, axis of rotating shaft; 20, cylinder; 21, compression intake port; 22, first compression exhaust port; 23, compression intake buffer tank; 24, second compression exhaust port; 25, receiving groove; 26, limiting plate; 30, piston component; 31, variable volume cavity; 311, guide hole; 32, piston; 321, sliding hole; 33, piston sleeve; 331, connecting convex ring; 333, axis of piston sleeve; 332, first thrust surface; 40, exhaust valve component; 41, exhaust valve; 42, valve baffle; 43, first fastener; 50, upper flange; 60, lower flange; 61, supporting plate; 611, second thrust surface; 70, second fastener; 80, third fastener; 81, fourth fastener; 82, fifth fastener; 90, dispenser part; 91, housing component; 92, motor component; 93, pump body component; 94, upper cover component; and 95, lower cover and mounting plate.

DETAILED DESCRIPTION OF THE EMBODIMENTS

It is important to note that embodiments in the present application and characteristics in the embodiments may be combined mutually under the condition of no conflicts. The present disclosure will be illustrated herein below with reference to the drawings and in conjunction with the embodiments in detail.

It should be pointed out that the following detailed descriptions are exemplary and intended to provide a further description for the present application. Unless specified otherwise, all technical and scientific terms used herein have the same meanings as those usually understood by a person of ordinary skill in the art of the present application.

In the present disclosure, on the contrary, used nouns of locality such as "left and right" are usually left and right as shown in the drawings, "interior and exterior" refer to interior and exterior of an own profile of each part, but the above nouns of locality are not used to limit the present disclosure.

In order to solve the problem in the related art in which fluid machinery is unstable in motion and large in vibration and has clearance volume, the present disclosure provides fluid machinery and heat exchange equipment, wherein the heat exchange equipment includes the following fluid machinery. In addition, also provided is an operating method for fluid machinery.

The fluid machinery mainly includes a compressor and an expander which will be introduced respectively hereinbelow. The general characteristics of the fluid machinery are introduced first.

As shown in FIG. 2 to FIG. 21, the fluid machinery includes an upper flange 50, a lower flange 60, a cylinder 20, a rotating shaft 10 and a piston component 30, wherein the cylinder 20 is sandwiched between the upper flange 50 and the lower flange 60; the axis of the rotating shaft 10 is eccentric to the axis of the cylinder 20 and at a fixed eccentric distance, and the rotating shaft 10 sequentially penetrates through the upper flange 50, the cylinder 20 and the lower flange 60; and the piston component 30 is provided with a variable volume cavity 31, the piston component 30 being pivotally provided in the cylinder 20, and the rotating shaft 10 being drivingly connected with the piston component 30 to change the volume of the variable volume cavity 31. Herein, the upper flange 50 is fixed to the cylinder 20 via a second fastener 70, and the lower flange 60 is fixed to the cylinder 20 via a third fastener 80.

Preferably, the second fastener 70 and/or the third fastener 80 are/is screws or bolts.

Because the eccentric distance between the rotating shaft 10 and the cylinder 20 is fixed, the rotating shaft 10 and the cylinder 20 rotate around the respective axes thereof during motion, and the position of the center of mass remains unchanged, so that the piston component 30 is allowed to rotate stably and continuously when moving in the cylinder 20; and vibration of the fluid machinery is effectively mitigated, a regular pattern for changes in the volume of the variable volume cavity is ensured, and clearance volume is reduced, thereby increasing the operational stability of the fluid machinery, and increasing the working reliability of heat exchange equipment.

It is important to note that the axis of the upper flange 50 and the axis of the lower flange 60 are coaxial with the axis of the rotating shaft 10, and the axis of the upper flange 50 and the axis of the lower flange 60 are eccentric to the axis of the cylinder 20. A fixed eccentric distance between the cylinder 20 mounted in the above manner and the rotating shaft 10 or the upper flange 50 can be ensured, so that the piston component 30 has the characteristic of good motion stability.

The rotating shaft 10 and the piston component 30 in the present disclosure are slidably connected, and the volume of the variable volume cavity 31 is changed along with the rotation of the rotating shaft 10. Because the rotating shaft 10 and the piston component 30 in the present disclosure are slidably connected, the motion reliability of the piston component 30 is ensured, and the problem of motion stop of the piston component 30 is effectively avoided, thereby endowing a regular characteristic for changes in the volume of the variable volume cavity 31.

As shown in FIG. 2, FIG. 8 to FIG. 14, FIG. 16 and FIG. 17, the piston component 30 includes a piston sleeve 33 and a piston 32, wherein the piston sleeve 33 is pivotally provided in the cylinder 20, the piston 32 is slidably provided in the piston sleeve 33 to form the variable volume cavity 31, and the variable volume cavity 31 is located in a sliding direction of the piston 32.

In the specific embodiment, the piston component 30 is in sliding fit with the rotating shaft 10, and along with the rotation of the rotating shaft 10, the piston component 30 has a tendency of straight motion relative to the rotating shaft 10, thereby converting rotation into local straight motion. Because the piston 32 and the piston sleeve 33 are slidably connected, under the driving of the rotating shaft 10, motion stop of the piston 32 is effectively avoided, so as to ensure the motion reliability of the piston 32, the rotating shaft 10 and the piston sleeve 33, thereby increasing the operational stability of the fluid machinery.

It is important to note that the rotating shaft 10 in the present disclosure does not have an eccentric structure, thereby facilitating vibration of the fluid machinery.

Specifically speaking, the piston 32 slides in the piston sleeve 33 along a direction vertical to the axial direction of the rotating shaft 10 (see FIG. 2, FIG. 8 to FIG. 13, and FIG. 22). Because a cross slider mechanism is formed among the piston component 30, the cylinder 20 and the rotating shaft 10, the motion of the piston component 30 and the cylinder 20 is stable and continuous, and a regular pattern for changes in the volume of the variable volume cavity 31 is ensured, thereby ensuring the operational stability of the fluid machinery, and increasing the working reliability of heat exchange equipment.

The piston 32 in the present disclosure is provided with a sliding hole 321 running through an axial direction of the rotating shaft 10, the rotating shaft 10 penetrates through the sliding hole 321, and the piston 32 rotates along with the rotating shaft 10 under the driving of the rotating shaft 10 and slides in the piston sleeve 33 along a direction vertical to the axial direction of the rotating shaft 10 in a reciprocating manner (see FIG. 8 to FIG. 13, FIG. 16 and FIG. 17). Because the piston 32 is allowed to make a straight motion instead of a rotational reciprocating motion relative to the rotating shaft 10, the eccentric quality is effectively reduced, and lateral forces exerted on the rotating shaft 10 and the piston 32 are reduced, thereby reducing the abrasion of the piston 32, and increasing the sealing property of the piston 32. Meanwhile, the operational stability and reliability of a pump body component 93 are ensured, the vibration risk of the fluid machinery is reduced, and the structure of the fluid machinery is simplified.

Preferably, the sliding hole 321 is an slotted hole or a waist-shaped hole.

In a preferable implementation manner not shown in the figures, the piston 32 is provided with a sliding groove facing one side of the rotating shaft 10. Either the sliding groove or the sliding hole 321 is required to ensure relatively reliable sliding between the rotating shaft 10 and the piston 32. The sliding groove is a straight sliding groove, and an extending direction of the sliding groove is vertical to the axis of the rotating shaft 10.

The piston 32 in the present disclosure is columnar. Preferably, the piston 32 is cylindrical or non-cylindrical.

Figure 2:
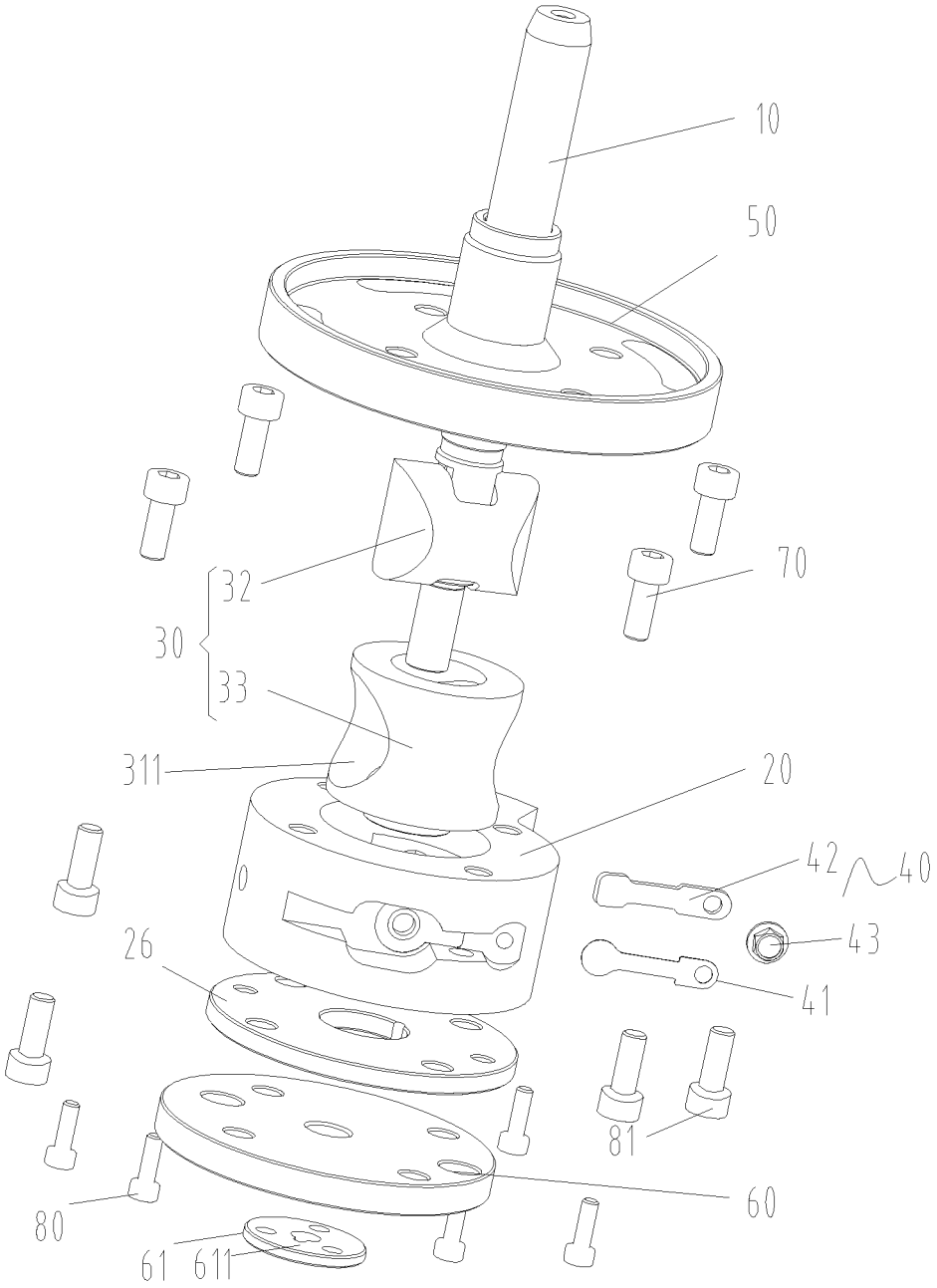
FIG. 2 shows an exploded view of a pump body component in the present disclosure.
Figure 3:
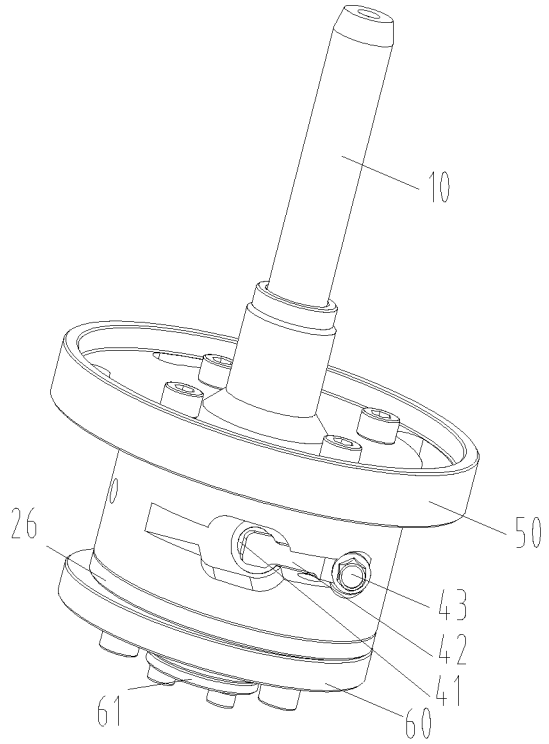
FIG. 3 shows a schematic diagram of a mounting relationship among a rotating shaft, an upper flange, a cylinder and a lower flange in the present disclosure.
Figure 16:
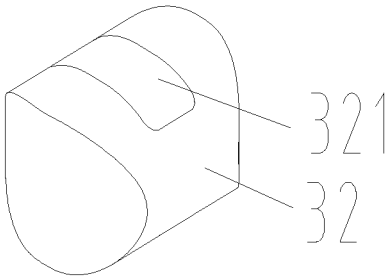
FIG. 16 shows a structure diagram of a piston in the present disclosure.
Figure 17:
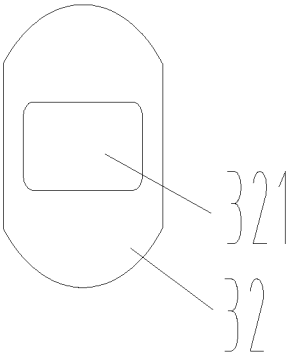
FIG. 17 shows a structure diagram of a piston in FIG. 16 from another perspective.

As shown in FIG. 2, FIG. 16 and FIG. 17, the piston 32 is provided with a pair of arc-shaped surfaces arranged symmetrically about a middle vertical plane of the piston 32, the arc-shaped surfaces adaptively match an inner surface of the cylinder 20, and the double arc curvature radius of the arc-shaped surfaces is equal to the inner diameter of the cylinder 20. Thus, zero-clearance volume can be implemented in an exhaust process. It is important to note that when the piston 32 is placed in the piston sleeve 33, the middle vertical plane of the piston 32 is an axial plane of the piston sleeve 33.

Figure 18:
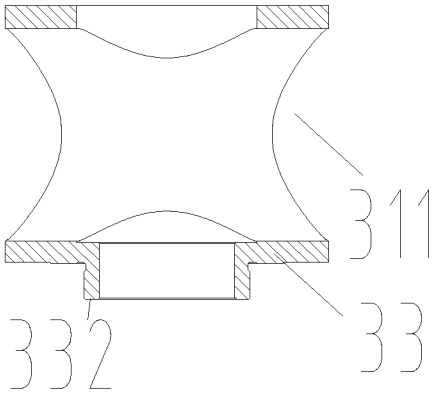
FIG. 18 shows a sectional view of a piston sleeve in the present disclosure.

In a preferable implementation manner as shown in FIG. 2 and FIG. 18, a guide hole 311 running through a radial direction of the piston sleeve 33 is provided in the piston sleeve 33, and the piston 32 is slidably provided in the guide hole 311 to make a straight reciprocating motion. Because the piston 32 is slidably provided in the guide hole 311, when the piston 32 moves leftwards and rightwards in the guide hole 311, the volume of the variable volume cavity 31 can be continuously changed, thereby ensuring the suction and exhaust stability of the fluid machinery.

In order to prevent the piston 32 from rotating in the piston sleeve 33, an orthographic projection of the guide hole 311 at the lower flange 60 is provided with a pair of parallel straight line segments, the pair of parallel straight line segments is formed by projecting a pair of parallel inner wall surfaces of the piston sleeve 33, and the piston 32 is provided with outer profiles which are in shape adaptation to and in sliding fit with a pair of parallel inner wall surfaces of the guide hole 311. If the piston 32 and the piston sleeve 33 fit by adopting the above structure, the piston 32 can be allowed to smoothly slide in the piston sleeve 33, and a sealing effect is maintained.

Preferably, an orthographic projection of the guide hole 311 at the lower flange 60 is provided with a pair of arc-shaped line segments, the pair of arc-shaped line segments being connected with the pair of straight line segments to form an irregular section shape.

As shown in FIG. 2, the peripheral surface of the piston sleeve 33 is adaptive to the inner wall surface of the cylinder 20 in shape. Thus, large-area sealing is performed between the piston sleeve 33 and the cylinder 20 and between the guide hole 311 and the piston 32, and overall sealing is large-area sealing, thereby facilitating rechanneling of leakage.

As shown in FIG. 18, a first thrust surface 332 of a side, facing the lower flange 60, of the piston sleeve 33 is in contact with the surface of the lower flange 60. Thus, the piston sleeve 33 and the lower flange 60 are reliably positioned.

Figure 6:
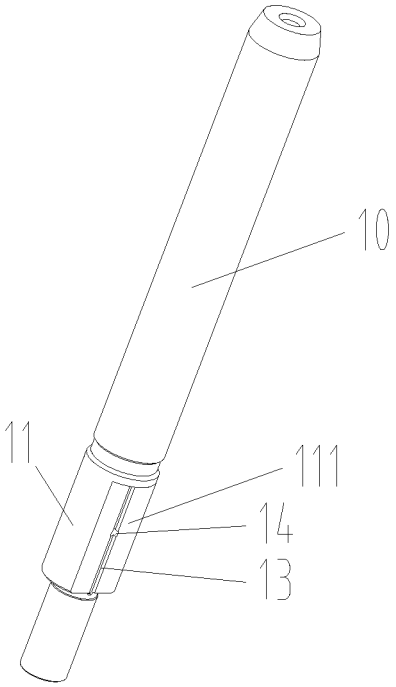
FIG. 6 shows a structure diagram of a rotating shaft in the present disclosure.
Figure 7:
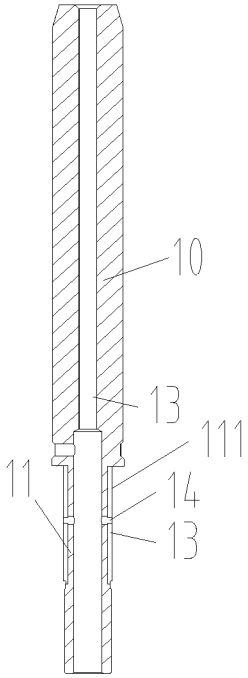
FIG. 7 shows an internal structure diagram of a rotating shaft in FIG. 6.
Figure 8:
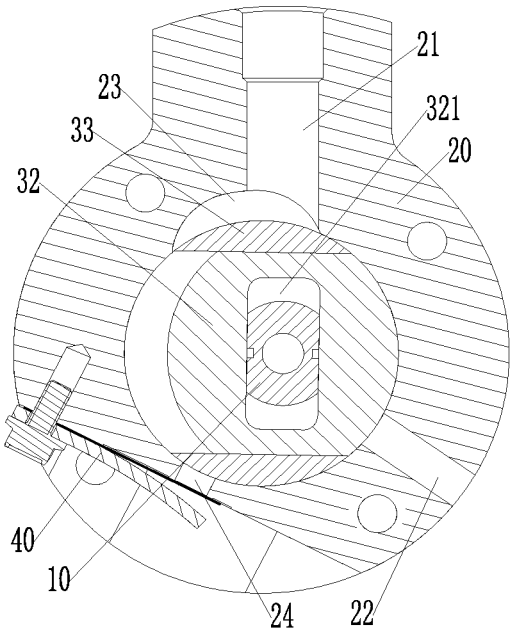
FIG. 8 shows a working state diagram of a piston prepared for suction in the present disclosure.
Figure 9:
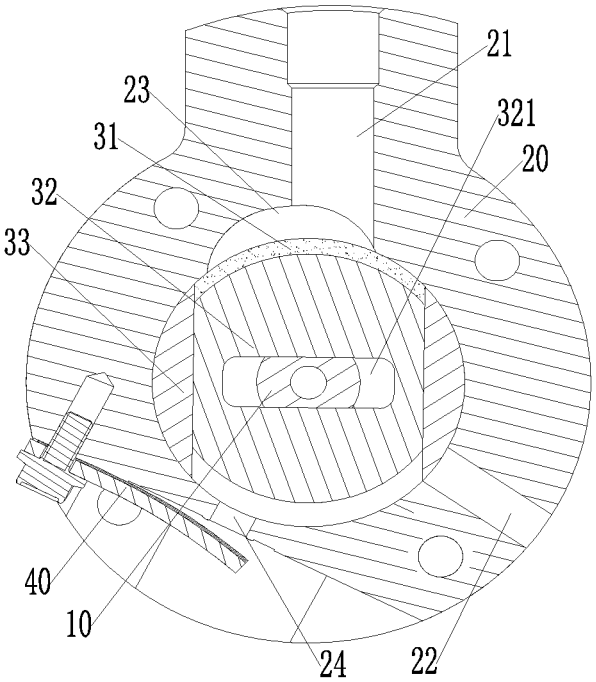
FIG. 9 shows a working state diagram of a piston during suction in the present disclosure.
Figure 10:
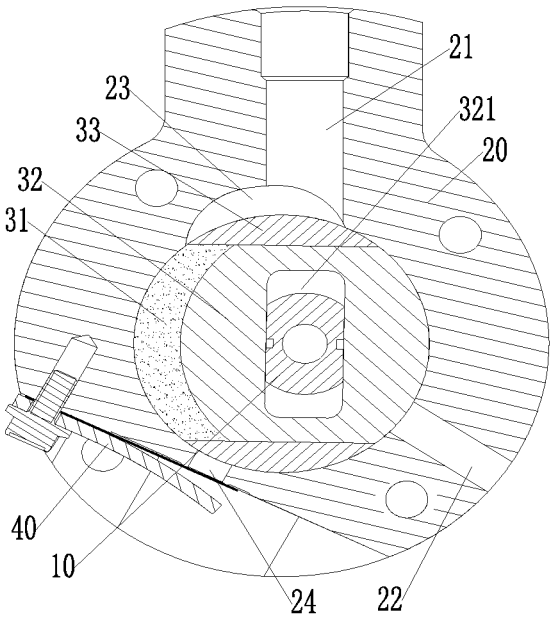
FIG. 10 shows a working state diagram of a piston completing suction in the present disclosure.
Figure 11:
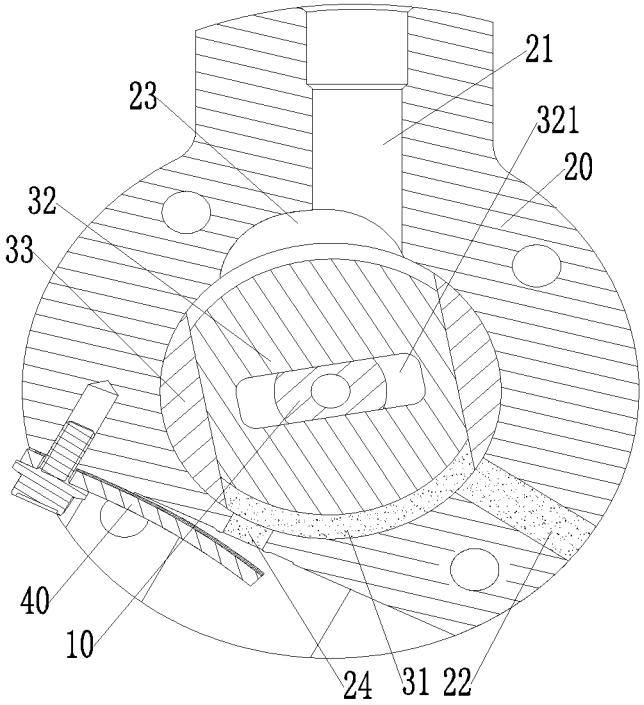
FIG. 11 shows a working state diagram of a piston during gas compression and exhaust in the present disclosure.
Figure 12:
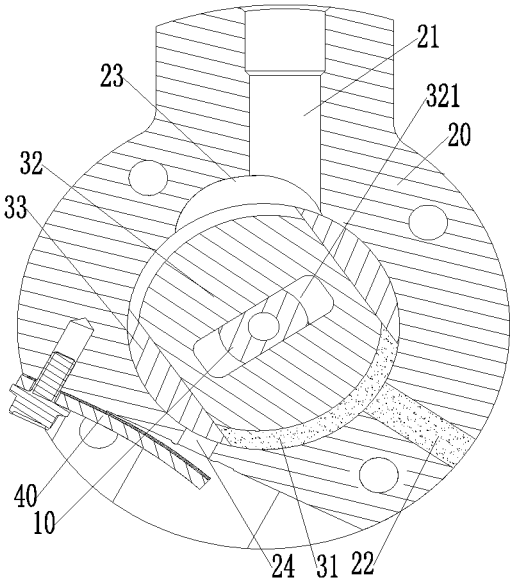
FIG. 12 shows a working state diagram of a piston during exhaust in the present disclosure.
Figure 13:
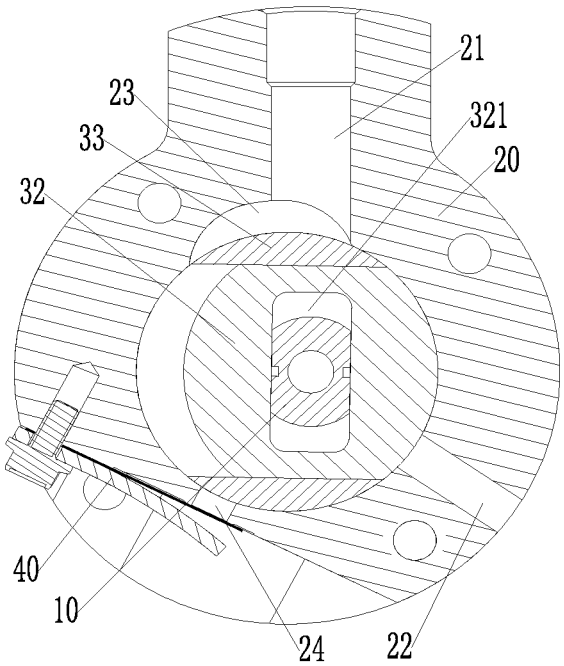
FIG. 13 shows a working state diagram of a piston which will complete exhaust in the present disclosure.
Figure 14:
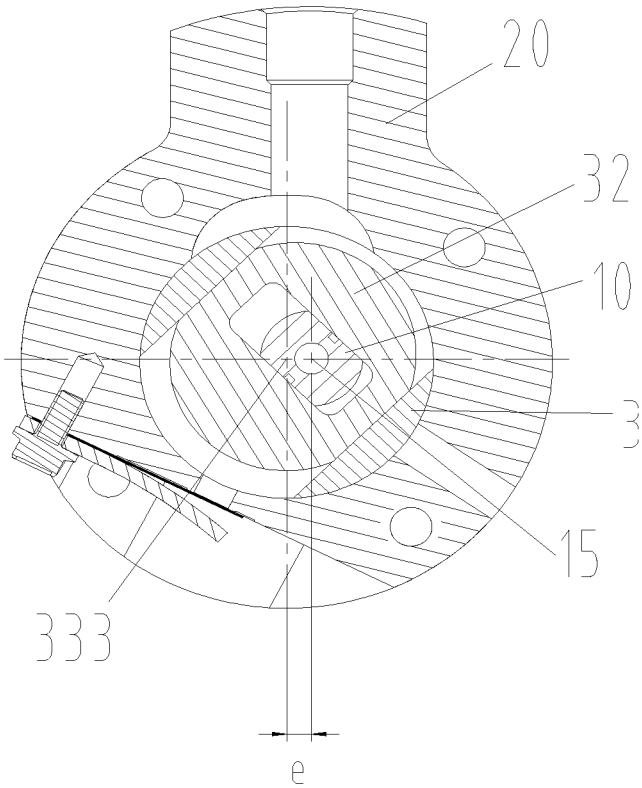
FIG. 14 shows a schematic diagram of an eccentric relationship between a piston sleeve and a rotating shaft in the present disclosure.

As shown in FIG. 6 and FIG. 7, the rotating shaft 10 is provided with a sliding segment 11 in sliding fit with the piston component 30, the sliding segment 11 is located between two ends of the rotating shaft 10, and the sliding segment 11 is provided with sliding fit surfaces 111. Because the rotating shaft 10 is in sliding fit with the piston 32 via the sliding fit surfaces 111, the motion reliability therebetween is ensured, and jam therebetween is effectively avoided.

Preferably, the sliding segment 11 is provided with two sliding fit surfaces 111 which are symmetrically arranged. Because the sliding fit surfaces 111 are symmetrically arranged, the two sliding fit surfaces 111 are stressed more uniformly, thereby ensuring the motion reliability of the rotating shaft 10 and the piston 32.

As shown in FIG. 6 and FIG. 7, the sliding fit surfaces 111 are parallel with an axial plane of the rotating shaft 10, and the sliding fit surfaces 111 are in sliding fit with an inner wall surface of the sliding hole 321 of the piston 32 in a direction vertical to the axial direction of the rotating shaft 10.

The rotating shaft 10 in the present disclosure is provided with a oil passage 13, the oil passage 13 including an internal oil channel provided inside the rotating shaft 10, an external oil channel arranged outside the rotating shaft 10 and an oil communication hole 14 communicating the internal oil channel and the external oil channel. Because at least part of the oil passage 13 is the internal oil channel, great leakage of lubricating oil is effectively avoided, and the flowing reliability of the lubricating oil is increased. In the presence of the oil communication hole 14, the internal oil channel and the external oil channel can be smoothly communicated, and oil can be injected to the oil passage 13 via the oil communication hole 14, thereby ensuring the oil injection convenience of the oil passage 13.

In a preferable implementation manner as shown in FIG. 6 and FIG. 7, the external oil channel extending along the axial direction of the rotating shaft 10 is provided at the sliding fit surfaces 111. Because the oil passage 13 at the sliding fit surfaces 111 is the external oil channel, lubricating oil can be directly supplied to the sliding fit surfaces 111 and the piston 32, and abrasion caused by over-large friction there between is effectively avoided, thereby increasing the motion smoothness there between.

The compressor in the present disclosure further includes a supporting plate 61, the supporting plate 61 is provided on an end face, away from one side of the cylinder 20, of the lower flange 60, the supporting plate 61 is coaxial with the lower flange 60, the rotating shaft 10 penetrates through a through hole in the lower flange 60 and is supported on the supporting plate 61, and the supporting plate 61 is provided with a second thrust surface 611 for supporting the rotating shaft 10. Because the supporting plate 61 is configured to support the rotating shaft 10, the connection reliability between all parts is increased.

Figure 4:
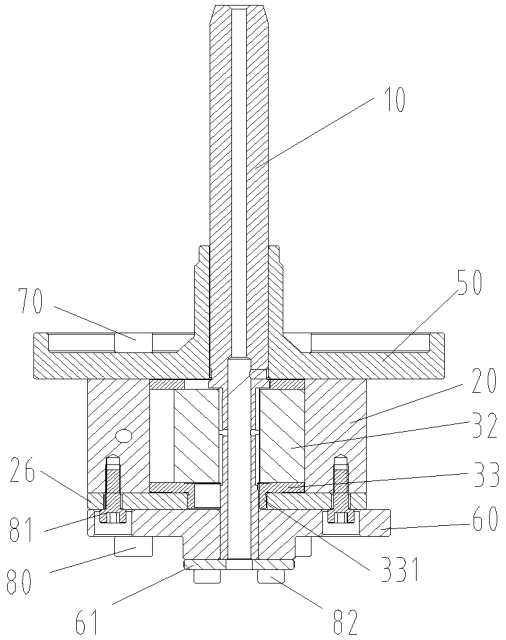
FIG. 4 shows an internal structure diagram of a part in FIG. 3.
Figure 19:
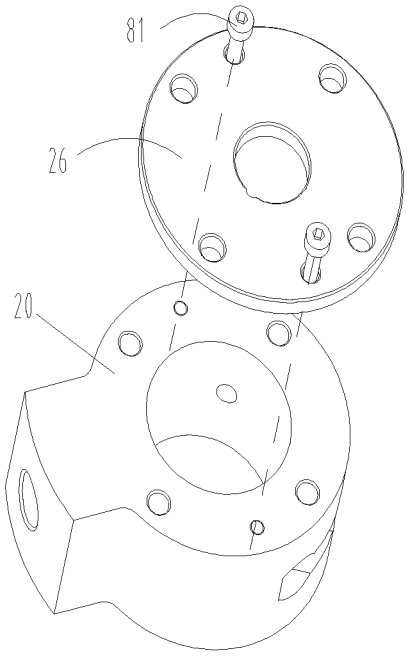
FIG. 19 shows a schematic diagram of a connecting relationship between a limiting plate and a cylinder in the present disclosure.
Figure 20:
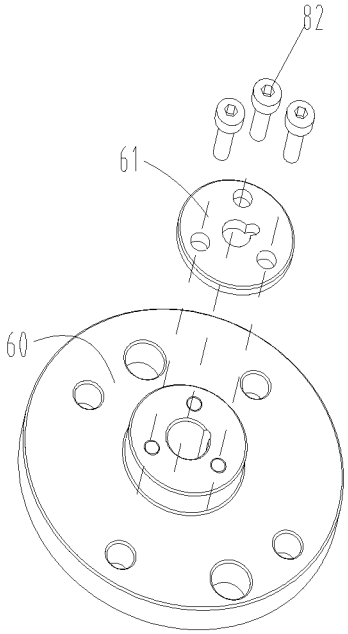
FIG. 20 shows a schematic diagram of a connecting relationship between a supporting plate and a lower flange in the present disclosure.

As shown in FIG. 4 and FIG. 19, a limiting plate 26 is connected with the cylinder 20 via a fifth fastener 82.

Preferably, the fifth fastener 82 is a bolt or screw.

Figure 21:
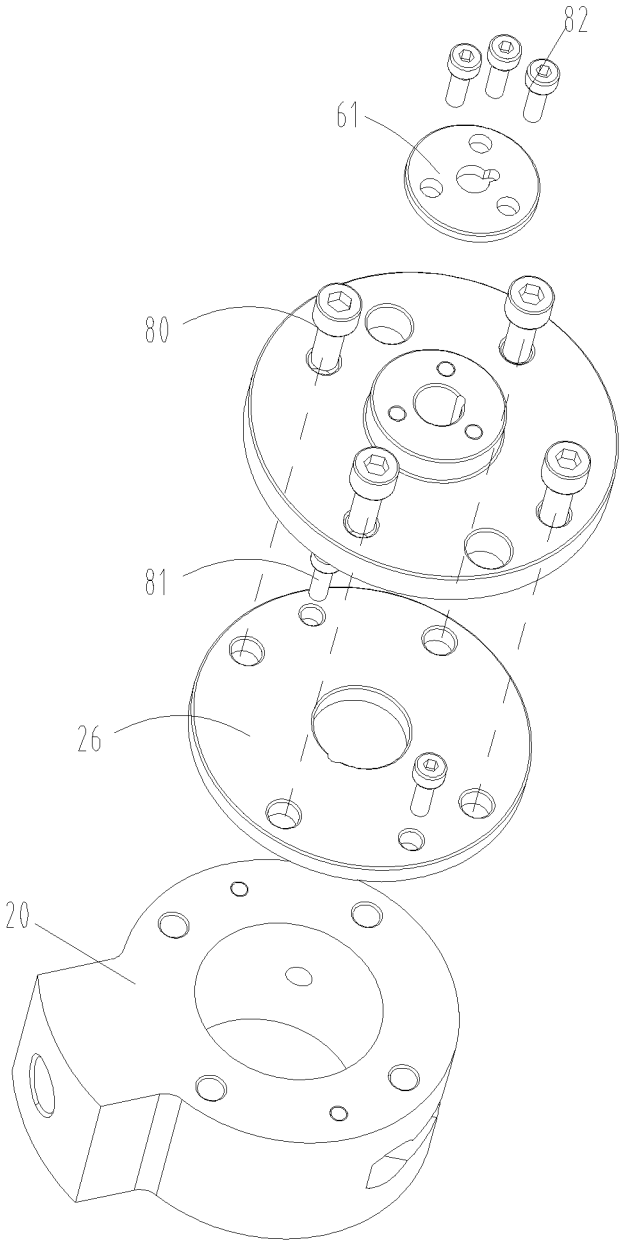
FIG. 21 shows a schematic diagram of a connecting relationship among a cylinder, a limiting plate, a lower flange and a supporting plate in the present disclosure.

As shown in FIG. 2, FIG. 19 and FIG. 21, the compressor in the present disclosure further includes a limiting plate 26, the limiting plate 26 being provided with an avoidance hole for avoiding the rotating shaft 10, and the limiting plate 26 being sandwiched between the lower flange 60 and the piston sleeve 33 and coaxial with the piston sleeve 33. Due to the arrangement of the limiting plate 26, the limiting reliability of each part is ensured.

As shown in FIG. 4 and FIG. 19, the limiting plate 26 is connected with the cylinder 20 via a fourth fastener 81.

Preferably, the fourth fastener 81 is a bolt or screw.

Specifically speaking, the piston sleeve 33 is provided with a connecting convex ring 331 protruding towards one side of the lower flange 60, the connecting convex ring 331 being embedded into the avoidance hole. Due to fit between the piston sleeve 33 and the limiting plate 26, the motion reliability of the piston sleeve 33 is ensured.

Specifically speaking, the piston sleeve 33 in the present disclosure includes two coaxial cylinders with different diameters, the outer diameter of an upper half part is equal to the inner diameter of the cylinder 20, and the axis of the guide hole 311 is vertical to the axis of the cylinder 20 and fits with the piston 32, wherein the shape of the guide hole 311 remains consistent with that of the piston 32. In a reciprocating motion process, gas compression is achieved. A lower end face of the upper half part is provided with concentric connecting convex rings 331, is a first thrust surface, and fits with the end face of the lower flange 60, thereby reducing the structure friction area. A lower half part is a hollow column, namely a short shaft, the axis of the short shaft is coaxial with that of the lower flange 60, and in a motion process, they rotate coaxially.

As shown in FIG. 1, the fluid machinery is a compressor. The compressor includes a dispenser part 90, a housing component 91, a motor component 92, a pump body component 93, an upper cover component 94, and a lower cover and mounting plate 95, wherein the dispenser part 90 is arranged outside the housing component 91; the upper cover component 94 is assembled at the upper end of the housing component 91; the lower cover and mounting plate 95 is assembled at the lower end of the housing component 91; both the motor component 92 and the pump body component 93 are located inside the housing component 91; and the motor component 92 is arranged above the pump body component 93. The pump body component 93 of the compressor includes the above-mentioned upper flange 50, lower flange 60, cylinder 20, rotating shaft 10 and piston component 30.

Preferably, all the parts are connected in a welding, shrinkage fit or cold pressing manner.

The assembly process of the whole pump body component 93 is as follows: the piston 32 is mounted in the guide hole 311, the connecting convex ring 331 is mounted on the limiting plate 26, the limiting plate 26 is fixedly connected with the lower flange 60, the cylinder 20 and the piston sleeve 33 are coaxially mounted, the lower flange 60 is fixed to the cylinder 20, the sliding fit surfaces 111 of the rotating shaft 10 and a pair of parallel surfaces of the sliding hole 321 of the piston 32 are mounted in fit, the upper flange 50 is fixed to the upper half section of the rotating shaft 10, and the upper flange 50 is fixed to the cylinder 20 via a screw. Thus, assembly of the pump body component 93 is completed, as shown in FIG. 4.

Preferably, there are at least two guide holes 311, the two guide holes 311 being spaced in the axial direction of the rotating shaft 10; and there are at least two pistons 32, each guide hole 311 being provided with the corresponding piston 32. At this time, the compressor is a single-cylinder multi-compression cavity compressor, and compared with a same-displacement single-cylinder roller compressor, the compressor is relatively small in torque fluctuation.

Preferably, the compressor in the present disclosure is not provided with a suction valve, so that the suction resistance can be effectively reduced, and the compression efficiency of the compressor is increased.

It is important to note that in the detailed description of the embodiments, when the piston 32 completes motion for a circle, suction and exhaust will be performed twice, so that the compressor has the characteristic of high compression efficiency. Compared with the same-displacement single-cylinder roller compressor, the compressor in the present disclosure is relatively small in torque fluctuation due to division of a compression into two compressions, has small exhaust resistance during operation, and effectively eliminates an exhaust noise.

Specifically speaking, as shown in FIG. 8 to FIG. 13, a cylinder wall of the cylinder 20 is provided with a compression intake port 21 and a first compression exhaust port 22, when the piston component 30 is located at an intake position, the compression intake port 21 is communicated with the variable volume cavity 31, and when the piston component 30 is at an exhaust position, the variable volume cavity 31 is communicated with the first compression exhaust port 22.

Preferably, an inner wall surface of the cylinder wall is provided with a compression intake buffer tank 23, the compression intake buffer tank 23 is communicated with the compression intake port 21 (see FIG. 8 to FIG. 13). In the presence of the compression intake buffer tank 23, a great amount of gas will be stored at this part, so that the variable volume cavity 31 can be full of gas to supply sufficient gas to the compressor, and in case of insufficient suction, the stored gas can be timely supplied to the variable volume cavity 31 so as to ensure the compression efficiency of the compressor.

Specifically speaking, the compression intake buffer tank 23 is provided with an arc-shaped segment in a radial plane of the cylinder 20, and the compression intake buffer tank 23 extends from the compression intake port 21 to one side where the first compression exhaust port 22 is located. An extending direction of the compression intake buffer tank 23 is consistent with a rotating direction of the piston component 30.

The cylinder wall of the cylinder 20 in the present disclosure is provided with a second compression exhaust port 24, the second compression exhaust port 24 is located between the compression intake port 21 and the first compression exhaust port 22, and during rotation of the piston component 30, a part of gas in the piston component 30 is depressurized by the second compression exhaust port 24 and then completely exhausted from the first compression exhaust port 22. Because only two exhaust paths are provided, namely a path of exhaust via the first compression exhaust port 22 and a path of exhaust via the second compression exhaust port 24, gas leakage is reduced, and the sealing area of the cylinder 20 is increased.

Preferably, the compressor (namely the fluid machinery) further includes an exhaust valve component 40, the exhaust valve component 40 being arranged at the second compression exhaust port 24. Because the exhaust valve component 40 is arranged at the second compression exhaust port 24, great leakage of gas in the variable volume cavity 31 is effectively avoided, and the compression efficiency of the variable volume cavity 31 is ensured.

Figure 5:
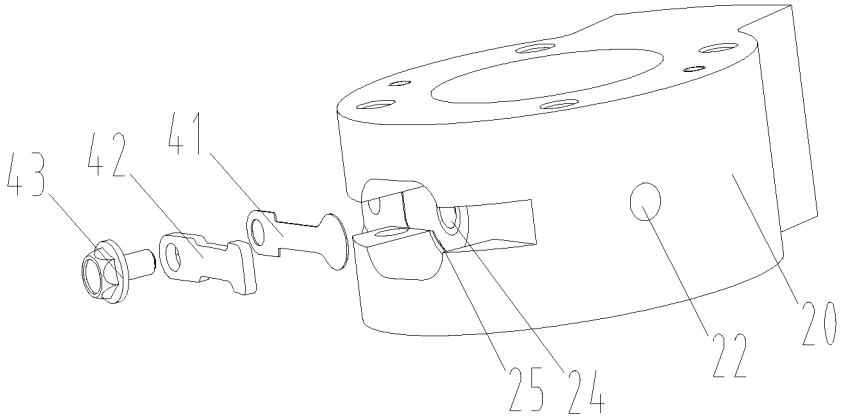
FIG. 5 shows a schematic diagram of a mounting relationship between an exhaust valve component and a cylinder in the present disclosure.

In a preferable implementation manner as shown in FIG. 5, a receiving groove 25 is provided on an outer wall of the cylinder wall, the second compression exhaust port 24 runs through the groove bottom of the receiving groove 25, and the exhaust valve component 40 is provided in the receiving groove 25. Due to the arrangement of the receiving groove 25 for receiving the exhaust valve component 40, the occupied space of the exhaust valve component 40 is reduced, and parts are arranged reasonably, thereby increasing the space utilization rate of the cylinder 20.

Specifically speaking, the exhaust valve component 40 includes an exhaust valve 41 and a valve baffle 42, the exhaust valve 41 being provided in the receiving groove 25 and shielding the second compression exhaust port 24, and the valve baffle 42 being overlaid on the exhaust valve 41. Due to the arrangement of the valve baffle 42, excessive opening of the exhaust valve 41 is effectively avoided, and the exhaust performance of the cylinder 20 is ensured.

Preferably, the exhaust valve 41 and the valve baffle 42 are connected via a first fastener 43. Further, the first fastener 43 is a screw.

It is important to note that the exhaust valve component 40 in the present disclosure can separate the variable volume cavity 31 from an external space of the pump body component 93, referred to as backpressure exhaust, that is, when the pressure of the variable volume cavity 31 is greater than the pressure of the external space (exhaust pressure) after the variable volume cavity 31 and the second compression exhaust port 24 are communicated, the exhaust valve 41 is opened to start exhausting; and if the pressure of the variable volume cavity 31 is still lower than the exhaust pressure after communication, the exhaust valve 41 does not work. At this time, the compressor continuously operates for compression until the variable volume cavity 31 is communicated with the first compression exhaust port 22, and gas in the variable volume cavity 31 is pressed into the external space to complete an exhaust process. The exhaust manner of the first compression exhaust port 22 is a forced exhaust manner.

The operation of the compressor will be specifically introduced below.

Figure 22:
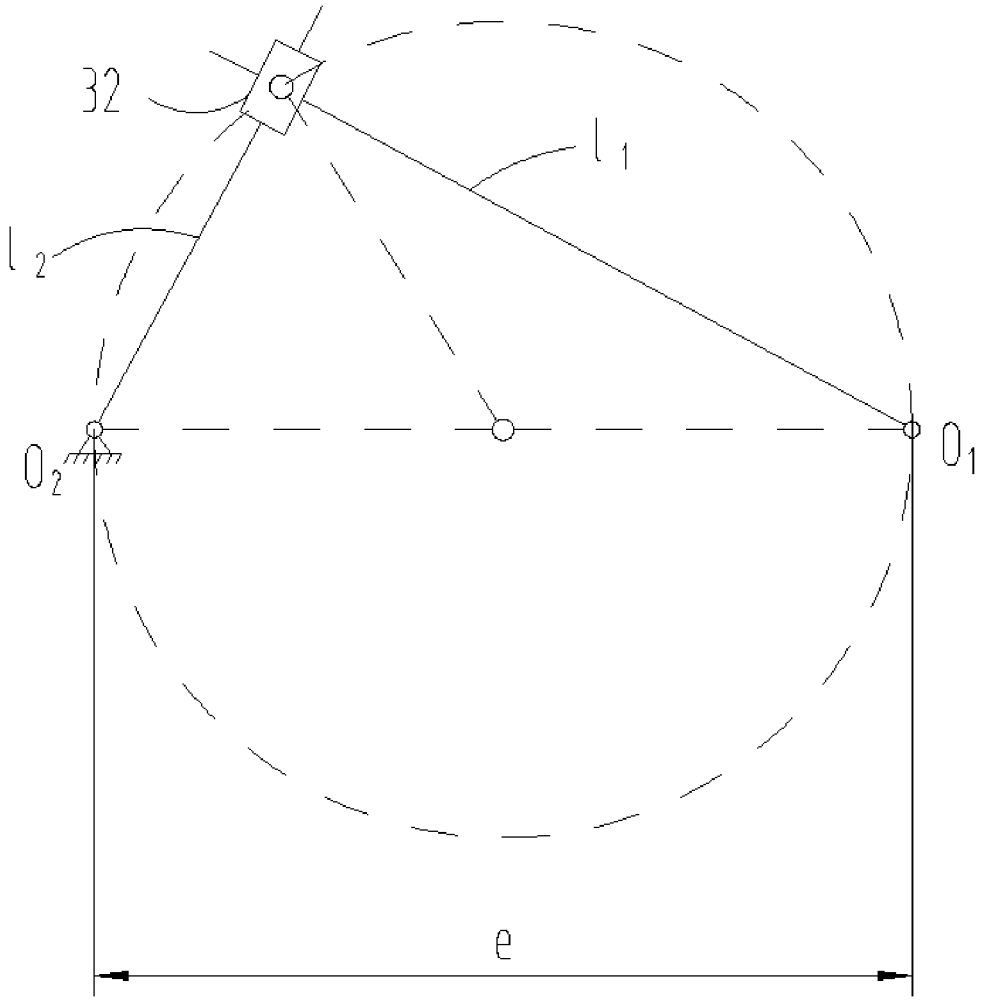
FIG. 22 shows a working principle diagram of a compressor in the present disclosure.
Figure 23:
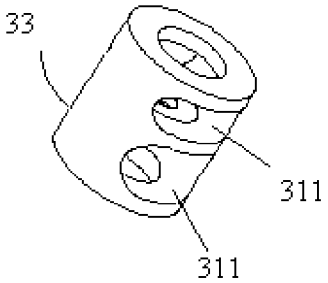
FIG. 23 shows two guide holes in the present disclosure.

As shown in FIG. 22, the compressor in the present disclosure adopts a principle of cross slider mechanism, wherein the piston 32 serves as a slider in the cross slider mechanism, the piston 32 and the sliding fit surface 111 of the rotating shaft 10 serve as a connecting rod $I_1$ in the cross slider mechanism, and the piston 32 and the guide hole 311 of the piston sleeve 33 serve as a connecting rod $I_2$ in the cross slider mechanism. Thus, a main structure of the principle of cross slider is formed. Moreover, the axis $O_1$ of the rotating shaft 10 is eccentric to the axis $O_2$ of the cylinder 20, and the rotating shaft and the cylinder rotate around the respective axes. When the rotating shaft 10 rotates, the piston 32 straightly slides relative to the rotating shaft 10 and the piston sleeve 33, so as to achieve gas compression. Moreover, the whole piston component 30 synchronously rotates along with the rotating shaft 10, and the piston 32 operates within a range of an eccentric distance e relative to the axis of the cylinder 20. The stroke of the piston 32 is 2e, the cross section area of the piston 32 is S, and the displacement of the compressor (namely maximum suction volume) is $V=2*(2e*S)$.

As shown in FIG. 22, when the fluid machinery adopting the above structure operates, the rotating shaft 10 rotates around the axis $O_1$ of the rotating shaft 10; the cylinder 20 rotates around the axis $O_2$ of the cylinder 20, wherein the axis of the rotating shaft 10 is eccentric to the axis of the cylinder 20 and at a fixed eccentric distance; and the piston 32 in the piston component 30 rotates along with the rotating shaft 10 under the driving of the rotating shaft 10 and slides in the piston sleeve 33 of the piston component 30 along a direction vertical to an axial direction of the rotating shaft 10 in a reciprocating manner.

The fluid machinery operating by using the above method forms the cross slider mechanism. The operating method adopts a principle of cross slider mechanism, wherein the piston 32 serves as a slider, the sliding fit surface 111 of the rotating shaft 10 serves as a first connecting rod $I_1$, and the guide hole 311 of the piston sleeve 33 serves as a second connecting rod $I_2$ (see FIG. 22).

Specifically speaking, the axis $O_1$ of the rotating shaft 10 is equivalent to the center of rotation of the first connecting rod $I_1$, and the axis $O_2$ of the cylinder 20 is equivalent to the center of rotation of the second connecting rod $I_2$. The sliding fit surface 111 of the rotating shaft 10 is equivalent to the first connecting rod $I_1$, and the guide hole 311 of the piston sleeve 33 is equivalent to the second connecting rod $I_2$. The piston 32 is equivalent to the slider. The guide hole 311 is vertical to the sliding fit surface 111, the piston 32 only makes a reciprocating motion relative to the guide hole 311, and the piston 32 only makes a reciprocating motion relative to the sliding fit surface 111. After the piston 32 is simplified as the center of mass, it can be found that the operating trajectory is a circular motion, and the circle adopts a connecting line of the axis $O_2$ of the cylinder 20 and the axis $O_1$ of the rotating shaft 10 as a diameter.

When the second connecting rod $I_2$ makes a circular motion, the slider may make a reciprocating motion along the second connecting rod $I_2$. Meanwhile, the slider may make a reciprocating motion along the first connecting rod $I_1$. The first connecting rod $I_1$ and the second connecting rod $I_2$ always remain vertical, such that the direction of the slider making the reciprocating motion along the first connecting rod $I_1$ is vertical to the direction of the slider making the reciprocating motion along the second connecting rod $I_2$. A relative motion relationship between the first connecting rod $I_1$ and the second connecting rod $I_2$ as well as the piston 32 forms a principle of cross slider mechanism.

Figure 15:
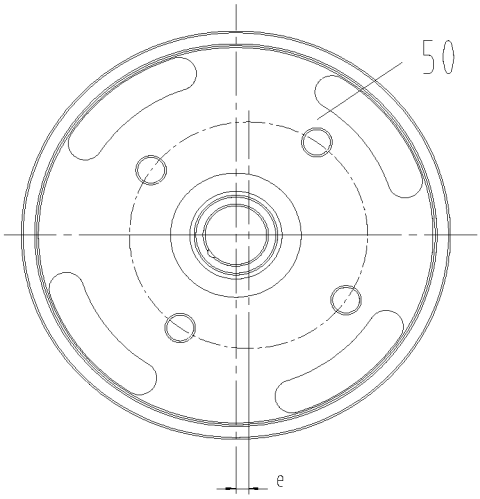
FIG. 15 shows a structure diagram of an upper flange in the present disclosure.

Under this motion method, the slider makes a circular motion, an angular speed thereof being equal to rotating speeds of the first connecting rod $I_1$ and the second connecting rod $I_2$. The operating trajectory of the slider is a circle. The circle adopts a center distance between the center of rotation of the first connecting rod $I_1$ and the center of rotation of the second connecting rod $I_2$ as a diameter. As shown in FIG. 15, an eccentric distance e exists between the axis 15 of the rotating shaft and the axis 333 of the piston sleeve, and a center-of-mass trajectory line of the piston is circular.

Specifically speaking, the motor component 92 drives the rotating shaft 10 to rotate, the sliding fit surface 111 of the rotating shaft 10 drives the piston 32 to move, and the piston 32 drives the piston sleeve 33 to rotate. In the whole motion part, the piston sleeve 33 only makes a circular motion, the piston 32 makes a reciprocating motion relative to both the rotating shaft 10 and the guide hole 311 of the piston sleeve 33, and the two reciprocating motions are vertical to each other and carried out simultaneously, so that the reciprocating motions in two directions form a motion mode of cross slider mechanism. A composite motion similar to the cross slider mechanism allows the piston 32 to make a reciprocating motion relative to the piston sleeve 33, the reciprocating motion periodically enlarging and reducing a cavity formed by the piston sleeve 33, the cylinder 20 and the piston 32. The piston 32 makes a circular motion relative to the cylinder 20, the circular motion allowing the variable volume cavity 31 formed by the piston sleeve 33, the cylinder 20 and the piston 32 to be communicated with the compression intake port 21 and the exhaust port periodically. Under the combined action of the above two relative motions, the compressor may complete the process of suction, compression and exhaust.

In addition, the compressor in the present disclosure also has the advantages of zero clearance volume and high volume efficiency.

The compressor in the present disclosure is a variable pressure ratio compressor, and the exhaust pressure ratio of the compressor may be changed by adjusting the positions of the first compression exhaust port 22 and the second compression exhaust port 24 according to the operational conditions of the compressor, so as to optimize the exhaust performance of the compressor. When the second compression exhaust port 24 is closer to the compression intake port 21 (clockwise), the exhaust pressure ratio of the compressor is small; and when the second compression exhaust port 24 is closer to the compression intake port 21 (anticlockwise), the exhaust pressure ratio of the compressor is large.

In addition, the compressor in the present disclosure also has the advantages of zero clearance volume and high volume efficiency.

Under other using occasions, the compressor may be used as an expander by changing the positions of a suction port and an exhaust port. That is, the exhaust port of the compressor serves as an expander suction port, high-pressure gas is charged, other pushing mechanisms rotate, and gas is exhausted from the suction port of the compressor (expander intake port) after expansion.

When the fluid machinery is the expander, the cylinder wall of the cylinder 20 is provided with an expansion exhaust port and a first expansion intake port, when the piston component 30 is located at an intake position, the expansion exhaust port is communicated with the variable volume cavity 31, and when the piston component 30 is at an exhaust position, the variable volume cavity 31 is communicated with the first expansion intake port. When high-pressure gas enters the variable volume cavity 31 through the first expansion intake port, the high-pressure gas pushes the piston component 30 to rotate, the piston sleeve 33 rotates to drive the piston 32 to rotate, the piston 32 is allowed to slide straightly relative to the piston sleeve 33, and the piston 32 further drives the rotating shaft 10 to rotationally move. By connecting the rotating shaft 10 to other power consumption equipment, the rotating shaft 10 may output to apply work.

Preferably, the inner wall surface of the cylinder wall is provided with an expansion exhaust buffer tank, the expansion exhaust buffer tank is communicated with the expansion exhaust port.

Further, the expansion exhaust buffer tank is provided with an arc-shaped segment in a radial plane of the cylinder 20, and the expansion exhaust buffer tank extends from the expansion exhaust port to one side where the first expansion intake port is located. An extending direction of the expansion exhaust buffer tank is consistent with a rotating direction of the piston component 30.

It is important to note that terms used herein are only intended to describe the detailed description of the embodiments, and not intended to limit exemplar implementations of the present application. For example, unless otherwise directed by the context, singular forms of terms used herein are intended to include plural forms. Besides, it will be also appreciated that when terms "contain" and/or "include" are used in the description, it is pointed out that features, steps, operations, devices, components and/or a combination thereof exist.

It is important to note that the description and claims of the present application and terms "first", "second" and the like in the drawings are used to distinguish similar objects, and do not need to describe a specific sequence or a precedence order. It should be understood that objects used in such a way can be exchanged under appropriate conditions, in order that the embodiments of the present disclosure described here can be implemented in a sequence except sequences graphically shown or described here.

The above is only the preferable embodiments of the present disclosure, and not intended to limit the present disclosure. As will occur to a person skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. Fluid machinery, comprising:

an upper flange (50);

a lower flange (60);

a cylinder (20), the cylinder (20) being sandwiched between the upper flange (50) and the lower flange (60);

a rotating shaft (10), the axis of the rotating shaft (10) being eccentric to the axis of the cylinder (20) and at a fixed eccentric distance, and the rotating shaft (10) sequentially penetrating through the upper flange (50), the cylinder (20) and the lower flange (60); and a piston component (30), the piston component (30) being provided with a variable volume cavity (31), the piston component (30) being pivotally provided in the cylinder (20), and the rotating shaft (10) being drivingly connected with the piston component (30) to change the volume of the variable volume cavity (31), a cylinder wall of the cylinder (20) is provided with a compression intake port (21) and a first compression exhaust port (22), when the piston component (30) is located at an intake position, the compression intake port (21) is communicated with the variable volume cavity (31), and when the piston component (30) is at an exhaust position, the variable volume cavity (31) is communicated with the first compression exhaust port (22), wherein the cylinder wall of the cylinder (20) is provided with a second compression exhaust port (24), the second compression exhaust port (24) is located between the compression intake port (21) and the first compression exhaust port (22), and during rotation of the piston component (30), a part of gas in the variable volume cavity (31) is depressurized by the second compression exhaust port (24) and then completely exhausted from the first compression exhaust port (22).

2. The fluid machinery as claimed in claim 1, wherein the piston component (30) comprises:

a piston sleeve (33), the piston sleeve (33) being pivotally provided in the cylinder (20); and a piston (32), the piston (32) being slidably provided in the piston sleeve (33) to form the variable volume cavity (31), and the variable volume cavity (31) being located in a sliding direction of the piston (32).

3. The fluid machinery as claimed in claim 2, wherein the piston (32) is provided with a sliding hole (321) running through an axial direction of the rotating shaft (10), the rotating shaft (10) penetrates through the sliding hole (321), and the piston (32) rotates along with the rotating shaft (10) under the driving of the rotating shaft (10) and slides in the piston sleeve (33) along a direction vertical to the axial direction of the rotating shaft (10) in a reciprocating manner.

4. The fluid machinery as claimed in claim 3, wherein the sliding hole (321) is an slotted hole or a waist-shaped hole.

5. The fluid machinery as claimed in claim 2, wherein the piston (32) is provided with a pair of arc-shaped surfaces arranged symmetrically about a middle vertical plane of the piston (32), the arc-shaped surfaces adaptively match an inner surface of the cylinder (20), and the double arc curvature radius of the arc-shaped surfaces is equal to the inner diameter of the cylinder (20).

6. The fluid machinery as claimed in claim 2, wherein the piston (32) is columnar.

7. The fluid machinery as claimed in claim 2, wherein a guide hole (311) running through a radial direction of the piston sleeve (33) is provided in the piston sleeve (33), and the piston (32) is slidably provided in the guide hole (311) to make a straight reciprocating motion.

8. The fluid machinery as claimed in claim 7, wherein an orthographic projection of the guide hole (311) at the lower flange (60) is provided with a pair of parallel straight line segments, the pair of parallel straight line segments is formed by projecting a pair of parallel inner wall surfaces of the piston sleeve (33), and the piston (32) is provided with outer profiles which are in shape adaptation to and in sliding fit with a pair of parallel inner wall surfaces of the guide hole (311).

9. The fluid machinery as claimed in claim 2, wherein a first thrust surface (332) of a side, facing the lower flange (60), of the piston sleeve (33) is in contact with the surface of the lower flange (60).

10. The fluid machinery as claimed in claim 3, wherein the rotating shaft (10) is provided with a sliding segment (11) in sliding fit with the piston component (30), the sliding segment (11) is located between two ends of the rotating shaft (10), and the sliding segment (11) is provided with sliding fit surfaces (111).

11. The fluid machinery as claimed in claim 10, wherein the sliding fit surfaces (111) are symmetrically provided on two sides of the sliding segment (11).

12. The fluid machinery as claimed in claim 10, wherein the sliding fit surfaces (111) are parallel with an axial plane of the rotating shaft (10), and the sliding fit surfaces (111) are in sliding fit with an inner wall surface of the sliding hole (321) of the piston (32), a slip direction of the piston (32) is vertical to the axial direction of the rotating shaft (10).

13. The fluid machinery as claimed in claim 10, wherein the rotating shaft (10) is provided with a oil passage (13), the oil passage (13) comprising an internal oil duct provided inside the rotating shaft (10), an external oil channel arranged outside the rotating shaft (10) and an oil communication hole (14) communicating the internal oil duct and the external oil channel.

14. The fluid machinery as claimed in claim 13, wherein the external oil channel extending along the axial direction of the rotating shaft (10) is provided at the sliding fit surfaces (111).

15. The fluid machinery as claimed in claim 1, wherein the upper flange (50) and the lower flange (60) are coaxial with the rotating shaft (10), and the axis of the upper flange (50) and the axis of the lower flange (60) being eccentric to the axis of the cylinder (20).

16. The fluid machinery as claimed in claim 9, further comprising a supporting plate (61), wherein the supporting plate (61) is provided on an end face, away from one side of the cylinder (20), of the lower flange (60), the supporting plate (61) is coaxial with the lower flange (60), the rotating shaft (10) penetrates through a through hole in the lower flange (60) and is supported on the supporting plate (61), and the supporting plate (61) is provided with a second thrust surface (611) for supporting the rotating shaft (10).

17. The fluid machinery as claimed in claim 2, further comprising a limiting plate (26), wherein the limiting plate (26) is provided with an avoidance hole for avoiding the rotating shaft (10), and the limiting plate (26) is sandwiched between the lower flange (60) and the piston sleeve (33) and coaxial with the piston sleeve (33).

18. The fluid machinery as claimed in claim 17, wherein the piston sleeve (33) is provided with a connecting convex ring (331) protruding towards one side of the lower flange (60), the connecting convex ring (331) being embedded into the avoidance hole.

19. The fluid machinery as claimed in claim 1, wherein an inner wall surface of the cylinder wall is provided with a compression intake buffer tank (23), the compression intake buffer tank (23) is communicated with the compression intake port (21).

20. The fluid machinery as claimed in claim 19, wherein the compression intake buffer tank (23) is provided with an arc-shaped segment in a radial plane of the cylinder (20), and the compression intake buffer tank (23) extends from the compression intake port (21) to one side where the first compression exhaust port (22) is located.

21. The fluid machinery as claimed in claim 1, further comprising an exhaust valve component (40), the exhaust valve component (40) being arranged at the second compression exhaust port (24).

22. The fluid machinery as claimed in claim 21, wherein a receiving groove (25) is provided on an outer wall of the cylinder wall, the second compression exhaust port (24) runs through the groove bottom of the receiving groove (25), and the exhaust valve component (40) is provided in the receiving groove (25).

23. The fluid machinery as claimed in claim 22, wherein the exhaust valve component (40) comprises:

an exhaust valve (41), the exhaust valve (41) being provided in the receiving groove (25) and shielding the second compression exhaust port (24); and a valve baffle (42), the valve baffle (42) being overlaid on the exhaust valve (41).

24. The fluid machinery as claimed in claim 1, wherein the fluid machinery being a compressor.

25. The fluid machinery as claimed in claim 7, wherein there are at least two guide holes (311), the two guide holes (311) being spaced in the axial direction of the rotating shaft (10); and there are at least two pistons (32), each guide hole (311) being provided with the corresponding piston (32).

26. Heat exchange equipment, comprising fluid machinery (100), wherein the fluid machinery being the fluid machinery as claimed in claim 1.

27. An operating method for fluid machinery, wherein the fluid machinery being the fluid machinery as claimed in claim 1, the operating method comprising:

allowing a rotating shaft (10) to rotate around the axis $O_1$ of the rotating shaft (10);

allowing a piston sleeve (33) to rotate around the axis $O_2$ of a cylinder (20), wherein the axis of the rotating shaft (10) is eccentric to the axis of the cylinder (20) and at a fixed eccentric distance; and driving, by the rotating shaft (10), a piston (32) of a piston component (30) to rotate along with the rotating shaft (10) and to slide in the piston sleeve (33) of the piston component (30) along a direction vertical to an axial direction of the rotating shaft (10) in a reciprocating manner.

28. The operating method as claimed in claim 27, adopting a principle of cross slider mechanism, wherein the piston (32) serves as a slider, a sliding fit surface (111) of the rotating shaft (10) serves as a first connecting rod $l_1$, and a guide hole (311) of the piston sleeve (33) serves as a second connecting rod $l_2$.

* * * * *